US006607193B2

(12) United States Patent
Nordling et al.

(10) Patent No.: US 6,607,193 B2
(45) Date of Patent: Aug. 19, 2003

(54) VACUUM-ASSIST FRICTION BELT FOR SHEET FEEDER

(75) Inventors: Neal Nordling, White Bear Lake, MN (US); Arild Vedoy, White Bear Lake, MN (US)

(73) Assignee: Multifeeder Technology, Inc., White Bear Lake, MN (US)

( * ) Notice: Subject to any disclaimer, the term of this patent is extended or adjusted under 35 U.S.C. 154(b) by 0 days.

(21) Appl. No.: 10/004,513

(22) Filed: Oct. 26, 2001

(65) Prior Publication Data

US 2003/0080492 A1 May 1, 2003

(51) Int. Cl.[7] ..... B65H 3/08

(52) U.S. Cl. ..... 271/99; 271/11; 271/12; 271/94; 271/103

(58) Field of Search ..... 71/11, 12, 94, 71/99, 103

(56) References Cited

U.S. PATENT DOCUMENTS 3,131,929 A * 5/1964 Rehm ..... 271/94
4,307,661 A * 12/1981 Wilkins et al. ..... 101/93.01
4,651,983 A 3/1987 Long ..... 271/35
5,557,387 A * 9/1996 Hatano ..... 399/381
5,888,047 A 3/1999 Auerbach et al. ..... 414/797.8
6,050,563 A 4/2000 Vedoy et al. ..... 271/10.07
6,082,727 A * 7/2000 Thompson ..... 271/94
6,189,883 B1 * 2/2001 Wright et al. ..... 271/96
6,293,535 B1 * 9/2001 Pfankuch ..... 271/3.23
6,412,770 B1 * 7/2002 Demmeler ..... 271/94

* cited by examiner

*Primary Examiner*—Donald P. Walsh
*Assistant Examiner*—Kaitlin S Joerger
(74) *Attorney, Agent, or Firm*—Steven E. Kahm; Thomas J. Nikolai; Nikolai & Mersereau, P.A.

(57) ABSTRACT

A conveyor belt for transporting articles having a plurality of apertures therein such that a vacuum applied to the apertures aids in forcing articles to stay on the conveyor belt while the articles are being translated. The conveyor is particularly useful for moving sheet articles such as a sheet feeder removing sheet articles from the bottom of a stack of sheet articles in a sheet feeder. The vacuum adds to the frictional force of the article on the conveyor belt and increases the productivity of the sheet feeder by reducing jams and increasing the frictional contact of the sheet article on the conveyor belt by removing chaff and other material form the conveyor belt.

13 Claims, 2 Drawing Sheets

VACUUM-ASSIST FRICTION BELT FOR SHEET FEEDER

BACKGROUND OF THE INVENTION

1. Field of the Invention

This invention relates to sheet feeding machines and more particularly to separating a sheet from the bottom of a stack one at a time with the assistance of a vacuum applied through a conveyor belt.

2. Description of the Related Art

Friction sheet feeders are known in the art and are commonly used in printers, plain paper copiers and the like to feed individual sheets, one at a time, from a stack of such sheets into the printer or copy machine. Friction feeders have also been used in mass mailing applications for assembling and collating packages of sheet materials between flights of a conveyor leading to a high-speed wrapper.

It is important in such applications that the friction feeder deliver products one at a time in synchronized relation to the operation of associated equipment accurately, reliably and repeatably. For example, in the mass mailing application, a plurality of friction feeders are arranged along a length of a transversely extending conveyor and each such friction feeder must deliver only one article at the time from its stack onto the conveyor as each defined flight thereof passes the discharge end of the friction feeder. The friction feeder must therefore operate reliably, at high speeds, over prolonged periods and with a minimum operator intervention for clearing jams or multiple feeds.

Relying on friction alone to provide the force necessary to pull a single sheet article by applying force of a belt and wheel is pressure sensitive. Too much pressure will leave scuff marks or otherwise damage the sheet article to be moved. Too little pressure results in the sheet article slipping relative to the wheel or belt resulting in jams or other problems. If glossy sheets of paper or other slippery surfaces on the sheet articles are used frictional contact may be reduced resulting in increased paper jams and a reduction in efficiency of the friction feeder. Further friction contact by wheels or belts may be compromised by chaff of other debris on the sheet articles to be moved reducing the effective friction contact. Adjusting the friction contact pressure of wheel or belts to the proper pressure can be difficult and needs to be set frequently to assure proper operation.

Some sheet feeding machines use air pressure or a vacuum to assist in gripping the sheet article to be transferred. For example U.S. Pat. No. 5,888,047 titled Separating and Feeding Machine for Bound Booklets, issued Mar. 30, 1999 uses a vacuum applied to a reciprocating box under the sheet article to be advanced to apply a force to the article.

The reciprocating box has several drawbacks in that it is constantly on even when the article is being pulled from the vacuum by rollers while the reciprocating box is moving counter to the effect of the rollers.

SUMMARY OF THE INVENTION

The device presented improves the performance of a sheet feeder by using a conveyor belt having apertures for use with a vacuum acting through the apertures on the conveyor belt to hold the sheet article on the conveyor belt while moving the article forward. The vacuum supplements the friction of the belt itself and releases the article from suction gradually as each piece moves off of the end of the conveyor belt. There is no reciprocating movement to impede the progress of the sheet article. Further the vacuum helps clean the sheet article and the belt for a better frictional grip by removing chaff and other particles. The vacuum is particularly useful on glossy paper or other slippery surfaced sheet articles to help grip and move the article.

OBJECTS OF THE INVENTION

It is an object of the invention to increase the force applied to a sheet article in a sheet feeder machine to separate the bottom most sheet article in a stack of sheet articles from the stack using a conveyor belt.

It is an object of the invention to reduce adjustments needed to apply the correct force to a sheet article to remove it from a stack by frictional contact.

It is an object of the invention to clean the sheet article and the conveyor belt while in use for better frictional contact between the sheet article and the conveyor belt.

It is an object of the invention to reduce jamming and improve the performance of sheet feeder machines.

Other objects, advantages and novel features of the present invention will become apparent from the following detailed description of the invention when considered in conjunction with the accompanying drawing.

DESCRIPTION OF THE PREFERRED EMBODIMENTS

Figure 1:
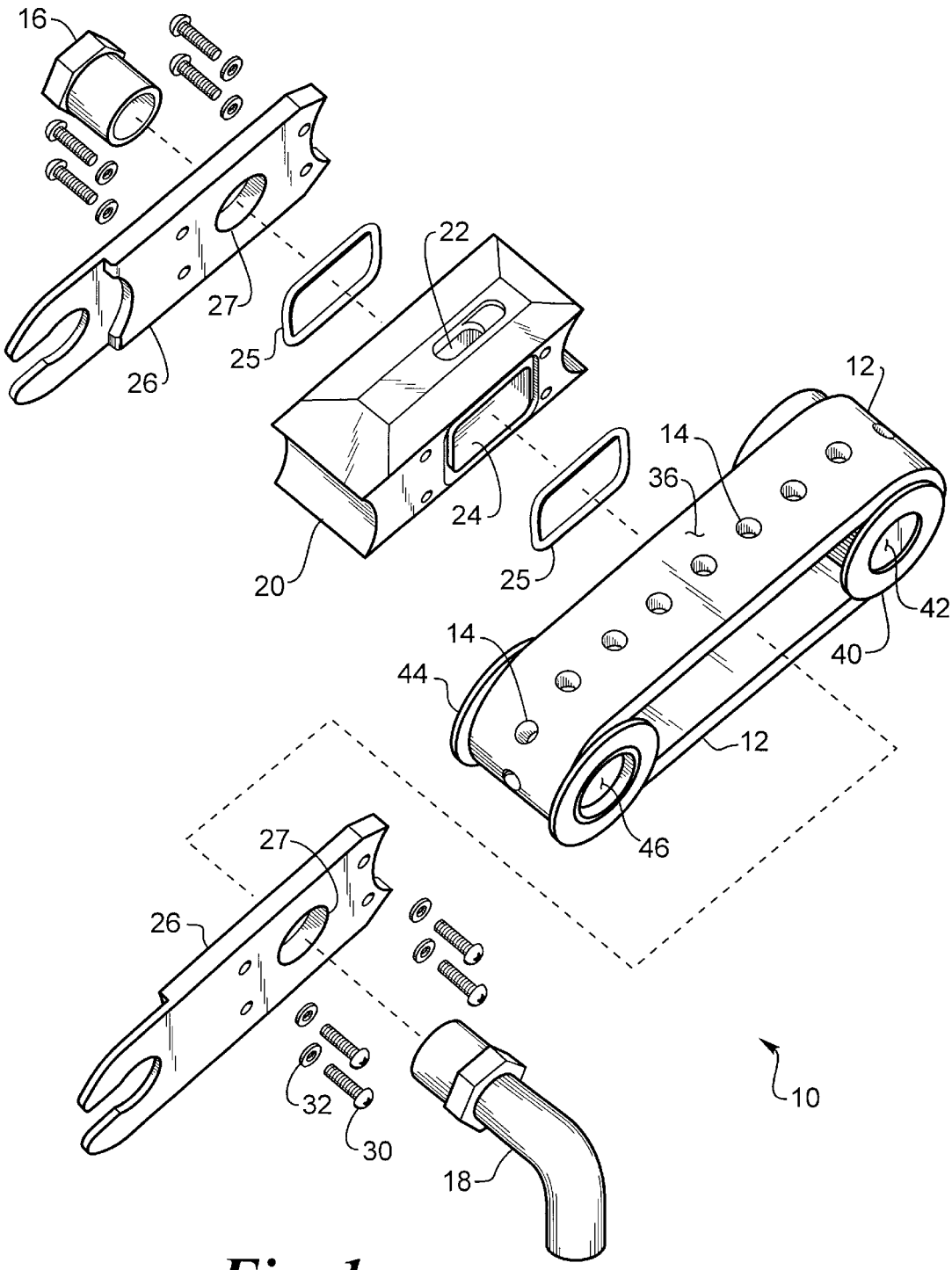
FIG. 1 is an expanded perspective view of the vacuum-assisted friction belt.
Figure 3:
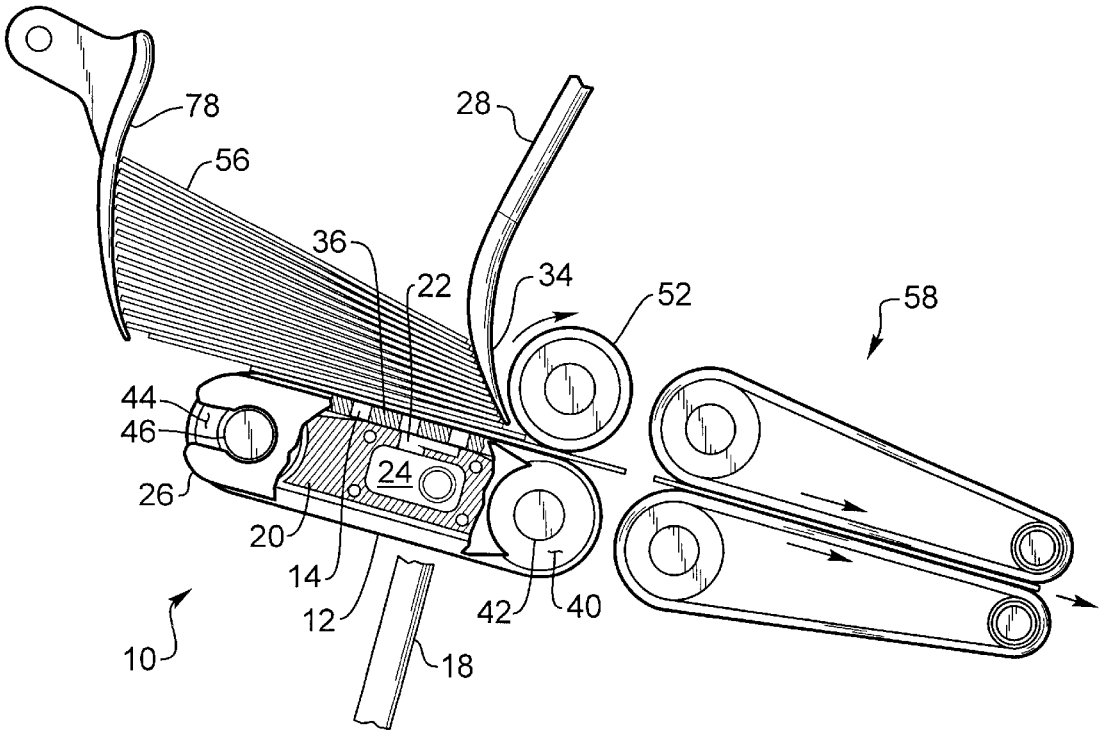
FIG. 3 a side view of the vacuum-assisted friction belt installed in a sheet feeder.

FIG. 1 shows an exploded view of the vacuum-assisted friction belt. A vacuum chamber 20 is supplied with a vacuum, from a source not shown, through vacuum pipe 18, which connects to the vacuum chamber 20 though aperture 24. With a vacuum in vacuum chamber 20 air will be sucked in through aperture 22 in the top of the vacuum chamber 20. Aperture 22 is a long oval shape in the top center of the vacuum chamber 20. The Aperture 22 aligns with apertures 14 in conveyor belt 12, which rotates such that the apertures 22 will allow air to pass through the belt 12 and into vacuum chamber 20. Any objects such as sheet articles 56, as seen in FIG. 3, resting on the conveyor belt 12 when passing over aperture 22 in the vacuum chamber 20 will experience a suction forcing the sheet article 56 downward onto the upper race 36 of conveyor belt 12 thus increasing the friction force applied to the sheet article 56. The increased force on the sheet article 56 on this portion of the conveyor belt will help feed the sheet articles 56 into the stripper wheels 52 of the sheet feeder to discharge belts 58. The vacuum force in addition to the frictional force is particularly useful for sheet articles 56 with glossy or slippery surfaces.

Figure 2:
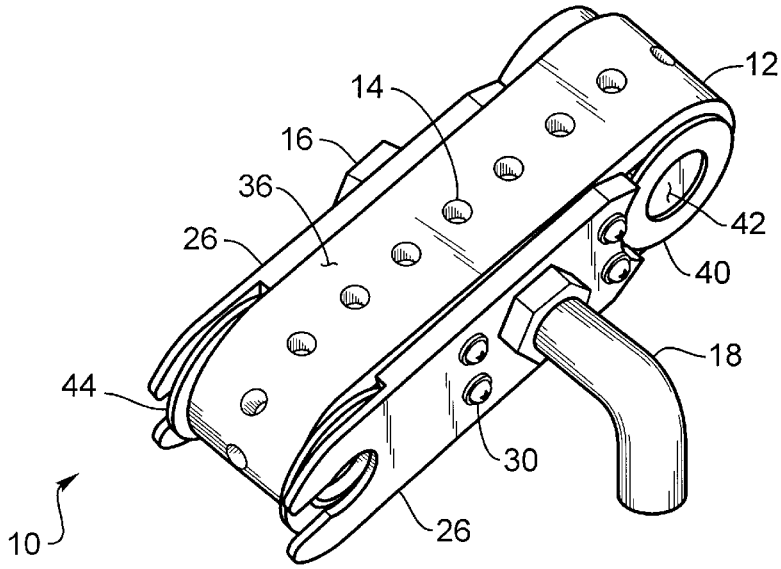
FIG. 2 is a perspective view of the vacuum-assisted friction belt.

As shown in FIG. 3 the assembled vacuum-assisted conveyor belt 10 of FIG. 2 is installed on the sheet feeder as disclosed in U.S. Pat. No. 6,050,563 issued Apr. 18, 2000 entitled Sheet Feeder, which is hereby attached hereto and incorporated herein by reference. The vacuum-assisted conveyor belt 10 helps to improve the contact with the sheet articles 56 on the conveyor belt 12 and thus more reliably removes sheet articles from the stack of sheet articles held between the rear guard member 78 and the guide 28. Therefore instead of just the weight of the sheet articles 56 contacting the upper race 36 of conveyor belt 12 providing the frictional force to remove the bottom sheet article 56 from the stack, the force of the vacuum acting on the bottom sheet article 56 through apertures 14 in the conveyor belt 12 increases the force applied to the sheet article helping to force it though the gap between the lower end portion 34 of the guide 28 and the conveyor belt 12. With the aperture 22 in the vacuum chamber 20 positioned near the stripper wheel 52 the sheet article is less likely to curl up and cause a jam in the sheet feeder. The vacuum will also help remove chaff and other particles which can come between the conveyor belt 12 and the sheet articles 56 reducing the frictional contact therebetween. The aperture 22 in the vacuum chamber 20 being on the forward portion of the stack limits the vacuum pressure being applied to the bottom most sheet article 56 as it is being moved to contact the stripper wheel 52 and does not simultaneously act on the following sheet article.

As shown in FIG. 3 the vacuum chamber 20 and conveyor belts 12 are installed in place of belts 38 of the sheet feeder shown in U.S. Pat. No. 6,050,563. In the embodiment shown in U.S. Pat. No. 6,050,563 there are two conveyor belts 38. The vacuum chamber 20 and conveyor belts 12 may be used in place of one or both of the conveyor belts 38 as shown in FIG. 8 of U.S. Pat. No. 6,050,563. In an alternative embodiment the width of the vacuum chamber 20 and conveyor belts 12 may be increased to cover a substantial portion of or the entire width of the sheet article 56 for increasing the vacuum force applied to the sheet articles. If the only one narrow vacuum chamber 20 and conveyor belt 12 is used will preferably be centered on the sheet article 56 to ensure a better alignment and feed of sheet articles with the stripper wheels 52 and discharge belts 58.

The detailed construction of the vacuum-assisted friction belt 10 is shown in FIG. 1 wherein the vacuum chamber 20 has gaskets 25 around apertures 24 on either side of the vacuum chamber 20. The side plates 26 are attached to the vacuum chamber 20 with screws 30 and spring lock washers 32 that press the gaskets 25 against the vacuum chamber 20 preventing air from entering the vacuum chamber through aperture 24.

The vacuum chambers 20 are symmetric. When two vacuum assisted friction belt apparatuses 10 are used there will be a right sided and left sided vacuum assisted friction belt apparatus 10. Assuming the FIGS. show a right sided vacuum chamber 20 the side plate 26 on the right side has a vacuum pipe 18 attached through aperture 27 for providing a vacuum inside of the vacuum chamber 20. The side plate 26 on the left side of the vacuum chamber 20 has a plug 16 blocking aperture 27. As can be readily understood the left vacuum-assisted friction belt apparatus 10 would have the plug 16 and the vacuum pipe 18 on opposite sides to the right vacuum-assisted friction belt apparatus 10.

As shown in FIG. 3 the idler roller 44 is attached to shaft 46 and roller 40 is attached to drive shaft 42. The conveyor belt 12 with apertures 14 extends over the idler roller 44 and roller 40 and is driven by roller 40. The vacuum chamber 20 is between the top and bottom of the conveyor belt 12. The top of the conveyor belt 12 is on the top of the vacuum chamber 20. The vacuum pressure on the conveyor belt 12 helps form a vacuum tight seal around the aperture 22 in the top of the vacuum chamber 20. As the apertures 14 in the conveyor belt 12 align with the aperture 22 in the top of the vacuum chamber 20 a vacuum is applied to the sheet articles 56 increasing the force applied to the sheet articles for moving them out from under the stack of sheet articles. As the sheet article 56 is propelled by the conveyor belt 12 past the end of the conveyor belt the suction force applied by the vacuum decreases as the number of apertures 14 on the conveyor belt 12 under the sheet article 56 subjected to the vacuum from the aperture 22 in vacuum chamber 20 decreases and eventually drops to zero, thus releasing the sheet article 56 to be moved by other belts rollers or other devices down stream of the conveyor belt 12.

The vacuum-assisted conveyor belt is shown herein in conjunction with a sheet feeder but may in general be used with any article moving apparatus.

The vacuum chamber 20 herein is shown with one oval shaped aperture 22 however any number of apertures may be used and the shapes of the apertures may vary.

Obviously, many modifications and variations of the present invention are possible in light of the above teachings. It is therefore to be understood that, within the scope of the appended claims, the invention may be practiced otherwise than as specifically described.

What is claimed is:

1. A vacuum-assisted conveyor belt on a sheet feeder for moving articles comprising, a curved front guide, a stripper wheel adjacent the front guide, a vacuum chamber having an aperture on the top, the aperture disposed under the curved front guide and stripper wheel, the vacuum chamber having second aperture connected to a vacuum pipe, for applying a vacuum to the vacuum chamber, a conveyor belt having at least one aperture therein moving adjacent to and in contact with the aperture in the top of vacuum chamber, such that when the aperture in the top of the vacuum chamber aligns with the at least one aperture in the conveyor belt a suction is applied to an article resting on the conveyor belt when there is a vacuum drawn on the vacuum chamber, to apply a force on a sheet article for separating the sheet from a stack and preventing curling of a leading edge of the sheet article as it engages the stripper wheel, a roller adjacent each end of the vacuum chamber for supporting and moving the conveyor belt.

2. A vacuum-assisted conveyor belt on a sheet feeder for moving articles as in claim 1 wherein, the vacuum chamber has a left side aperture and a right side aperture, a face plate attached to the left side of the vacuum chamber and a face plate attached to the right side of the vacuum chamber, the face plates having an aperture aligned with the vacuum chamber apertures for covering the left and right side apertures in the vacuum chamber, a plug for closing off one of either the left or right side face plate apertures, a vacuum pipe for attaching to one of either the left or right side face plate apertures, opposite the side the plug, for supplying a vacuum to the vacuum chamber.

3. A vacuum-assisted conveyor belt on a sheet feeder for moving articles as in claim 1 wherein, a means for delivering sheet articles to the conveyor belt is mounted adjacent the conveyor belt.

4. A vacuum-assisted conveyor belt on a sheet feeder for moving articles as in claim 1 wherein, a means for powering the conveyor belt in endless rotation is connected to a roller supporting the conveyor belt.

5. A vacuum-assisted conveyor belt on a sheet feeder for moving articles as in claim 1 wherein, a means for delivering the article to the conveyor belt for transport thereon.

6. A vacuum-assisted conveyor belt on a sheet feeder for moving articles as in claim 1 wherein, a means for accepting the article from the conveyor belt for movement away from the conveyor belt.

7. A vacuum-assisted conveyor belt on a sheet feeder for moving articles as in claim 2 wherein, a means for delivering sheet articles to the conveyor belt is mounted adjacent the conveyor belt.

8. A vacuum-assisted conveyor belt on a sheet feeder for moving articles as in claim 2 wherein, a means for powering the conveyor belt in endless rotation is connected to a roller supporting the conveyor belt.

9. A vacuum-assisted conveyor belt on a sheet feeder for moving articles as in claim 2 wherein, a means for delivering the article to the conveyor belt for transport thereon.

10. A vacuum-assisted conveyor belt on a sheet feeder for moving articles as in claim 2 wherein, a means for accepting the article from the conveyor belt for movement away from the conveyor belt.

11. A vacuum-assisted conveyor belt on a sheet feeder for moving articles as in claim 3 wherein, a means for delivering the article to the conveyor belt for transport thereon.

12. A vacuum-assisted conveyor belt on a sheet feeder for moving articles as in claim 3 wherein, a means for accepting the article from the conveyor belt for movement away from the conveyor belt.

13. A method of moving articles on a sheet feeder conveyor belt comprising:

providing a sheet feeder having a curved front guide for separating the articles, providing a stripper wheel proximate the front guide for engaging and moving the articles, providing a conveyor belt having a plurality of apertures therein for translating the articles, providing a vacuum chamber having an aperture disposed under and just upstream of the front guide for applying a vacuum to the articles through the apertures in the conveyor belt to hold the articles on the conveyor belt to separate them from the other articles and to ensure the article remains flat on the conveyor belt between the front guide and the stripper wheel.

* * * * *

UNITED STATES PATENT AND TRADEMARK OFFICE

CERTIFICATE OF CORRECTION

PATENT NO. : 6,607,193 B2
DATED : August 19, 2003
INVENTOR(S) : Neal Nordling and Arild Vedoy It is certified that error appears in the above-identified patent and that said Letters Patent is hereby corrected as shown below:

Column 4,
Line 25, insert the words -- and just upstream of -- between the words “under” and “the”.

Signed and Sealed this

Twentieth Day of January, 2004

JON W. DUDAS
*Acting Director of the United States Patent and Trademark Office*